United States Patent [19]

Nuckols et al.

[11] Patent Number: 4,534,468

[45] Date of Patent: Aug. 13, 1985

[54] CALENDAR-ORIENTED PILL DISPENSER

[76] Inventors: Walter S. Nuckols, 119 Putnam Park Rd., Bethel, Conn. 06801; Walter G. Leonard, 1017 Main St., Melrose, Mass. 02176; Henry P. Doble, Jr., Sunnyview Dr., Redding, Conn. 06875

[21] Appl. No.: 563,148

[22] Filed: Dec. 19, 1983

[51] Int. Cl.[3] ..... B65D 85/56; B65D 83/04; G09F 9/00

[52] U.S. Cl. ..... 206/534; 116/308; 206/459

[58] Field of Search ..... 206/534, 531, 539, 459; 116/308

[56] References Cited

U.S. PATENT DOCUMENTS

| | | | |
|---|---|---|---|
| 3,057,473 | 10/1962 | Stern et al. | 116/308 |
| 3,225,913 | 12/1965 | Lee | 206/534 |
| 3,278,010 | 10/1966 | Katz | 206/534 |
| 3,494,322 | 2/1970 | Dubbels | 206/531 |
| 3,942,641 | 3/1976 | Segre | 206/534 |

*Primary Examiner*—William T. Dixson, Jr.
*Attorney, Agent, or Firm*—Robert H. Ware; Melvin I. Stoltz; Alfred A. Fressola

[57] ABSTRACT

A method and apparatus to store and aid in the dispensing of calendar-oriented drugs is disclosed in which the apparatus comprises a package containing a plurality of pill-containing enclosures, the enclosures arranged in rows, each enclosure having a numerical indicia associated therewith corresponding to a day in a calendar month with corresponding indicia on the reverse side of the enclosure to aid in the determination of which pill enclosure to open. In this way the user can easily determine and verify that the proper enclosure has been opened. The package also provides a visual indication of calendar days for which pills have not been used by the patient and in this way provides patient compliance information to the physician prescribing such drugs. The dispensing apparatus is particularly suited to the administration of calendar-oriented prescription drugs for the treatment of menopausal symptoms.

20 Claims, 3 Drawing Figures

CALENDAR-ORIENTED PILL DISPENSER

TECHNICAL FIELD

Figure 1:
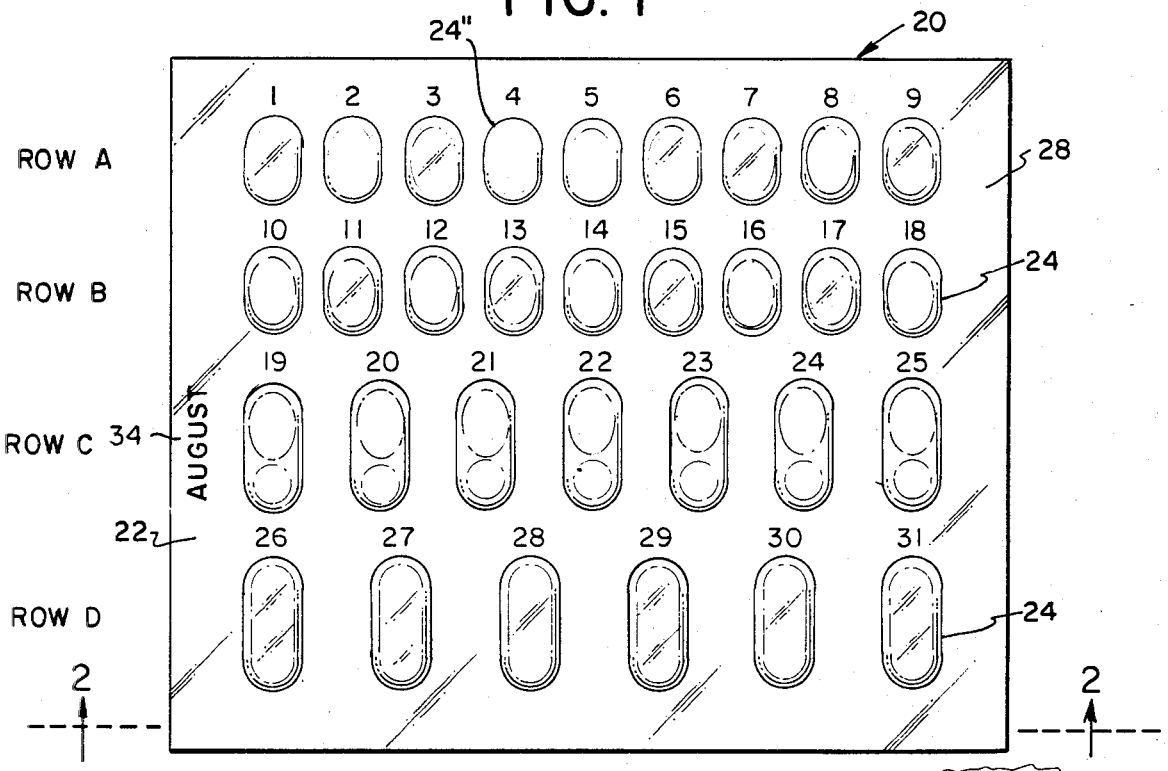

The present invention is directed to the packages and methods for dispensing pills and particularly packages for dispensing calendar-oriented drugs.

BACKGROUND ART

Many types of drugs are taken over a variety of days in varying amounts in order to provide for their effective administration. Packages have been developed for aiding the user of such drugs to comply with proper administration of those drugs over a period of days. Typical of such drugs are birth control pills which are taken over a period of days corresponding to a woman's menstrual cycle and the administration of anti-inflammatory drugs such as cortisone and cortisone-like drugs for the treatment of various ailments. None of the dispensing apparatus associated with such multiple day administered drugs is geared to administration of drugs on a calendar day basis; rather they are geared to the administration of drugs irrespective of the particular day of the month and indeed are typically administered so as to be timed to a body cycle.

The present invention is directed to the administration of the drugs in pill form whose administration is based upon the actual calendar date and thus are geared to initial administration on the first day of a given month. Thereafter, the patient continues to take the pill or pills on a daily basis, corresponding to the days of the month. If the patient fails to take the pill or pills for a given day, he or she merely takes the pill or pills for the following day leaving those for the previous day in the dispensing package. In this way, a complete verifiable record of patient compliance is available to the attending physician, thereby allowing the physician to be better able to determine what course of action to take depending upon the nature of this compliance.

The present invention is particularly suited for the administration of drugs for the treatment of menopausal symptoms. It is known that during the natural course of a woman's life she will experience a decrease in estrogen production normally between the ages of 45 and 55. Such decrease in estrogen production can also be caused by surgical removal of the ovaries. In either case, when the amount of estrogen in the blood begins to decrease, a woman may develop various systems including the feelings of warmth in the face, neck, chest, or sudden intense episodes of heat and sweating throughout the body (typically known as "hot flashes") with the severity of these symptoms varying from woman to woman. Some women also may develop atrophic vaginitis which can cause discomfort. In order to treat these symptoms, estrogens may be prescribed by the attending physician for a period of a few months or longer while the woman's body begins to adjust to her lower estrogen production levels.

It has also been discovered that a woman with lower estrogen production usually has a rapid loss of bone density with a resultant weakening of the structural integrity of the bones, thus increasing the risk of fracture. This general condition is known as osteoporosis; and, as reported in the *Update of the Journal of the American College of Obstetricians and Gynecologists,* Volume 7, Number 4, pages 2–3 (for year 1981) and Volume 8, Number 2, page 1 (for year 1982) it has been estimated that 25 percent of menopausal women will have fractures related to osteoporosis. Treatment for this problem is the administration of estrogen, progesterone and calcium to the patient, taken over the course of each calendar month. It has been recommended in these articles that post-menopausal women should take some form of calcium replacement, such as 1.5 grams per day of calcium carbonate, in order to replenish the calcium which is lost as a result of reduced estrogen and progesterone production.

The present invention presents a calendar-oriented prescriptive drug dispenser which can provide estrogen, progesterone, and calcium to a patient under the care of a gynecologist or other physician. In order to facilitate patient compliance, the present invention provides a dispenser in which the days of the month are associated with pill-containing enclosures having a one-to-one correspondence to each day of a calendar month. The patient is typically instructed to begin the medication on the first day of the next succeeding month and if a day is missed, to simply skip that pill-containing enclosure and continue with those for the remainder of the month. At the end of the month the physician, if he or she desires, can by examining the dispenser, ascertain the amount of patient compliance with the prescriptive drugs. It has been experimentally found that women who have used the dispenser according to the present invention have extremely high compliance with the prescriptive drug regimen, while those who are requested to take estrogen, progesterone, and calcium pills over the course of the month without this dispenser have relatively poor compliance with the regimen.

Thus the present invention provides the means for insuring high compliance with a calendar-oriented prescriptive drug regimen and also provides the means for determining this compliance by the attending physician.

SUMMARY OF THE INVENTION

A dispenser for containing pills for administration over a period of days associated with a calendar month is disclosed. The dispenser comprises a plurality of pill-containing enclosures, each enclosure containing one or more pills associated with a prescriptive regimen to be taken by a patient over the course of a calendar month. Each pill-containing enclosure has a number associated with it corresponding to one of the calendar days. The reverse side of the enclosure is preferably relatively smooth and contains a plurality of areas associated with each pill-containing enclosure through which the pill or pills within the enclosure may be removed by rupturing thereof. Each rupture area includes the same number corresponding to the calendar day that appears on the front side of the dispenser, thereby facilitating ease and assurance of proper pill(s) removal by the patient. If the patient forgets to take the pill or pills associated with a pill-containing enclosure for one or more days, these enclosures are left in their sealed state and thereby provide a visual means to inform the attending physician to determine the amount of compliance by the patient to the prescriptive drug regimen.

Preferably the pill-containing enclosures are made from a clear blister-pack plastic material so that the patient can readily see the pill(s) contained within the enclosure. The remainder of the dispenser is preferably formed from a flat stiff material, such as an aluminum foil laminated sheet, so as to provide the necessary rigidity to allow the patient to easily use the dispenser. The calendar indicia on the front surface of the dispenser may be placed above the corresponding pill-containing enclosure, or may be placed in any other location where there is a one-to-one relationship between each number and one pill-containing enclosure.

In one preferred embodiment of the present invention the dispenser is for the administration of post-menopausal prescriptive drugs for the treatment of menopausal symptoms and osteoporosis. In this embodiment of the invention, two rows each comprise nine pill enclosures, wherein each enclosure contains an estrogen replacement pill; while the next seven enclosures are positioned in a third row and contain both estrogen and progesterone pills; while a fourth row has six enclosures containing calcium replacement pills. This dispenser thus comprises thirty-one enclosures corresponding to the maximum number of days in any given month. The particular calendar month may also be indicated on the dispenser. In this embodiment the patient begins the prescriptive drug regimen on the first day of the next succeeding month and continues taking the pills from the enclosures corresponding to the days of the month. If the month has fewer than thirty-one days, those enclosures corresponding to days which do not exist are simply not used by the patient. The attending physician can then observe the dispenser after completion of a month's use.

OBJECTS OF THE INVENTION

Therefore it is the principal object of the present invention to provide a dispenser for pills to be administered on a calendar oriented basis, wherein the dispenser comprises a plurality of rupturable pill enclosures, each enclosure having an indicia associated with it on both its front and reverse sides corresponding to one of the days of the month so as to make a one-to-one correlation between each calendar date and a pill enclosure containing one or more pills to be taken on that calendar date.

Another object of the present invention is to provide a dispenser of the above description in which the pill-containing enclosures are formed from a transparent material so that the user can easily ascertain the pill or pills contained therein.

A still further object of the present invention is to provide a dispenser of the above description in which the pill-containing enclosures are arranged in a plurality of rows, each row corresponding to a uniform pill regimen.

Another object of the present invention is to provide a dispenser of the above description in which the pill-containing enclosures are formed onto a backing sheet formed from a relatively stiff planar material having easily rupturable zones placed beneath each pill-containing enclosure; and further wherein the indicia on the reverse side of this backing sheet are placed on these rupturable zones so as to facilitate the determination of which enclosure to dispense for a particular calendar date.

A still further object of the present invention is to provide a dispenser of the above description for use in the administration of calendar-oriented menopausal therapy drugs in which the first two rows of the pill-containing enclosures comprise nine pill-containing enclosures each corresponding to the first eighteen calendar days of a month for which estrogen replacement pills are stored, wherein a third row of the pill-containing enclosures comprises seven pill-containing enclosures for storing up to two pills associated with such menopausal therapy, and wherein a fourth row of pill-containing enclosures comprises six enclosures for the storage of a third drug to be administered for the retardation of osteoporosis in menopausal therapy.

Other objects of the present invention will in part be obvious and will in part appear hereinafter.

DRAWINGS

For a full understanding of the major objects of the present invention, reference should be made to the following detailed description taken in connection with the accompanying drawings, in which:

FIG. 1 is a top plan view of a dispenser for the administration of calendar oriented drugs illustrating a plurality of rows with pill-containing enclosures, each enclosure for the storage of one or more pills to be administered on a given calendar date further showing numerical indicia for the calendar date positioned in proximity to the pill-containing enclosure whose pill or pills are to be taken on that calendar date.

Figure 2:
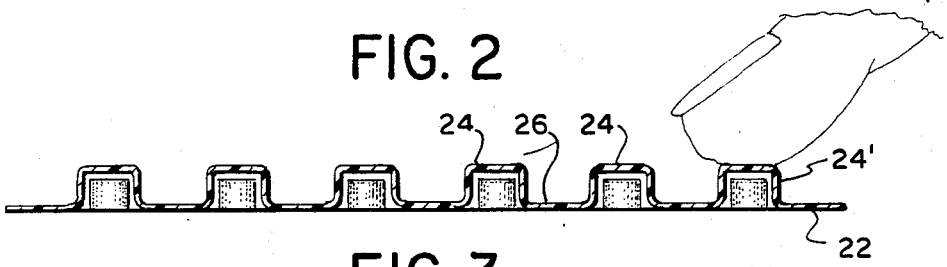

FIG. 2 is a side cross-sectional view taken along line 2—2 of FIG. 1 illustrating the manner in which the pill or or pills within a pill-containing enclosure are removed by rupturing the lower surface of the enclosure forming part of the backing sheet of the dispenser.

Figure 3:
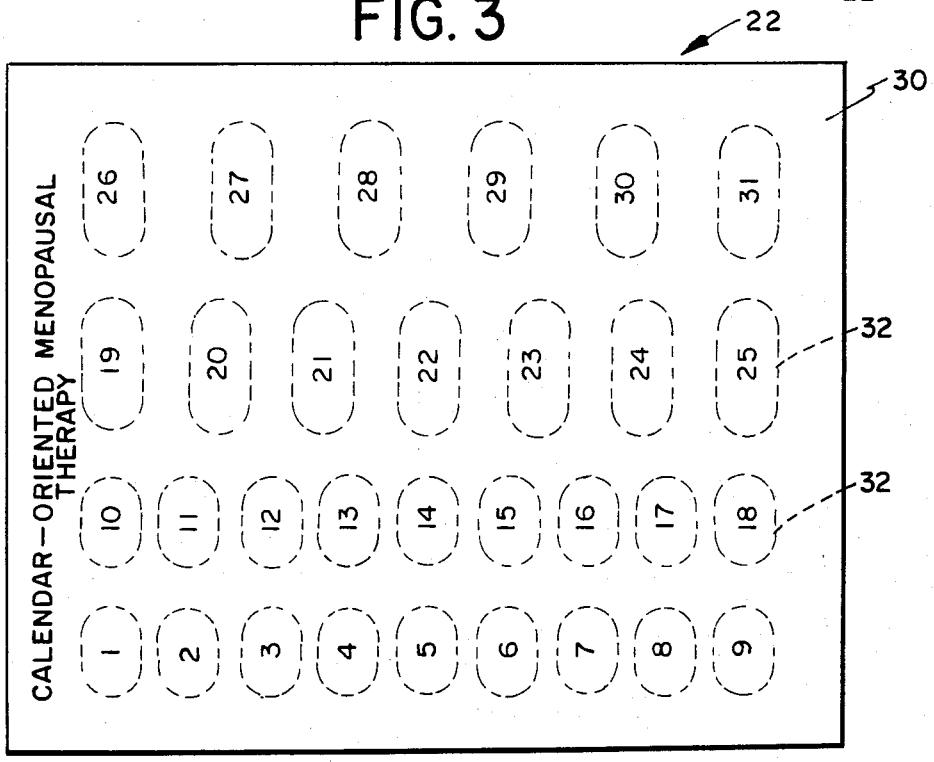

FIG. 3 is a bottom plan view of the dispenser shown in FIGS. 1 and 2 showing in phantom the zones on the rear surface of the backing sheet which correspond to the pill-containing enclosures and forming the lower surface of the pill-containing enclosures which are ruptured when the pills within the enclosures are removed, and further showing that each such zone has a number associated therewith which corresponds to the number shown on the front surface of the dispenser sheet corresponding to the calendar date for which the pills within the corresponding enclosure are to be taken by the patient.

BEST MODE FOR CARRYING OUT THE INVENTION

As best seen in FIG. 1, a dispenser 20 for calendar oriented drugs has a generally rectangular backing sheet 22 onto which are positioned a plurality of pill-containing enclosures 24. As seen in FIG. 2, the backing sheet 22 has a relatively thin cross-section and is preferably made from a relatively stiff sheet material, such as a reinforced aluminum foil sheet. The pill-containing enclosures are preferably fabricated from a clear thermal plastic material, forming part of an overall thermal plastic sheet 26 which can be sealingly attached to the underlying backing sheet. In the packaging art, this is commonly referred to as a blister-pack type packaging procedure.

As seen in FIGS. 1 and 2, each pill-containing enclosure is dimensioned to house a single pill for some enclosures or two pills or larger pills for other enclosures. Thus the pills in rows A and B of the embodiment shown in FIG. 1, are dimensioned to house a single pill, while those in row C are dimensioned to house two pills, and those in row D are dimensioned to house a pill relatively larger than those in rows A, B, or C.

It is also seen in FIG. 1 that the front surface 28 of the backing sheet 22 has a plurality of numerals ranging from 1 to 31, each numeral or numeral pair corresponding to a particular calendar date and each number positioned on the front surface of the backing sheets so as to be in proximity to a specific pill-containing enclosure. The dispenser is thus particularly designed for the administration of a pill regimen to a user where the user takes one or more pills on a specific calendar date. The front surface may optionally include indicia 34 indicating the particular month of the year for which the pills are to be taken.

As shown in FIG. 3, the rear surface 30 of backing sheet 22 has a plurality of zones 32, shown in phantom, which correspond to the area lying directly beneath the pill-containing enclosure caps 24. Each zone has a numerical indicia placed thereon, corresponding to the calendar date associated with the same pill-containing enclosure on the front surface. By placement of the number on each zone, the user can quickly ascertain if the pills for the correct date are being removed from the dispenser package. Each zone 32 thus forms a rupturable region for the removal of the pills within the corresponding enclosure by merely pressing the corresponding pill-enclosure dome 24 as shown in FIG. 2 for dome 24'.

For most calendar drug regimens, the user is instructed to take the pill or pills in the enclosure corresponding to the specific calendar date on only that date, and if the user forgets to take those pills on a particular date they are left intact in the dispenser. In this manner, the attending physician can readily determine the degree of patient compliance to a specific drug regimen. Thus, for example, the user may be instructed to begin use of the dispenser on the first day of a particular calendar month, for example August. In this case, the user for the first day of August would remove the pill or pills in the enclosure identified by the indicia "1" and for the second day of August would remove the pills for the indicia enclosure identified by the numeral "2", and so on. If, for example, the user forgot to take the pill or pills for the fourth of August, the pill or pills in the enclosure "4" would be left in the dispenser. The patient would continue to take the remaining pills on the day corresponding to that associated with each enclosure; and thus, on fifth of August would take the pill or pills contained in the enclosure identified by the numeral "5".

If the days of the particular month do not equal 31, then for those days exceeding the last day of the month the pill or pills are simply left in the dispenser. If, for example, the user was taking calendar oriented drugs for the month of September, then the pill or pills in the enclosure identified by the numeral "31" would be left in the dispenser. In this way, the attending physician can quickly ascertain the patient compliance with the drug regimen and can insure that extra pills were not taken for extra days exceeding those of a particular calendar month.

Specifically for the administration of estrogen in estrogen replacement therapy treatment, the present invention provides a unique approach to maximizing patient compliance and providing the means for ascertaining this compliance. It has been recently discovered, as mentioned above, that post-menopausal women experience a decrease in estrogen and progesterone production which causes various physiological symptoms including sudden feelings of warmth in the face, neck, chest, and sudden intense episodes of heat and sweating throughout the body, commonly referred to as "hot flashes" or "hot flushes." These symptoms can be alleviated to a great extent by the administration of estrogen and progesterone. It has also been clinically determined that reduced production of estrogen and progesterone causes, in some women, osteoporosis; that is a reduction in their bone mass with a concomitant propensity for bone fractures. Therapeutic estrogen and progesterone replacement is believed to counteract to a great extent this reduction in bone mass which is related to a reduction in the calcium of the bone. The present invention, when used for the administration of post-menopausal therapeutic purposes, therefore, provides estrogen over a period of 18 days, followed by 7 days of both estrogen and progesterone treatment, followed by from 3 to 7 days of calcium replacement during the days that the patient does not take estrogen or progesterone/estrogen combination. In this way, calcium is directly replaced during those days, while the days that estrogen and progesterone are taken these drugs act indirectly to retard bone mass depletion.

In a clinical study performed by joint inventor Walter G. Leonard, M.D., it has been found that patient compliance becomes extremely good when estrogen replacement therapy is conducted through a dispenser according to the present invention.

Thus the present invention has been found to provide an effective means for the proper administration of calendar oriented drug regimens since it provides the user with a direct one-to-one correlation between the pill or pills to be taken on a particular date and the date as shown by the calendar for the given month. It also provides an easily verifiable record of the patient's compliance with the calendar oriented prescription drug regimen.

Thus the dispenser through the use of rupturable pill-containing enclosures having indicia on both the front and rear surfaces of the dispenser provides an effective and easy-to-use device for both storing drugs and for their administration when directed to a calendar oriented regimen.

It will thus be seen that the objects set forth above, among those made apparent from the preceding description, are efficiently attained and, since certain changes may be made in carrying out the above construction and method set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention what is claimed is:

1. A unitary, non-reusable dispenser for the storage, dispensing, and patient compliance indication of calendar oriented pills comprising:

(A) a plurality of domes corresponding on a one-to-one basis with the days of at least one calendar month, each dimensioned for overlying one or more pills, the domes arranged in at least one row;

(B) a backing sheet with a front and rear surface, the backing sheet formed from a relatively stiff planar material with the domes positioned on the front surface thereof, the backing sheet having a plurality of zones corresponding to those areas overlaid by the domes, said zones being rupturable for release of the pill or pills which can be stored in the enclosure formed by the zone and the corresponding dome;

(C) consecutive integer indicia positioned in proximity to the domes in a one-to-one relationship thereto, so as to visually identify each dome with one and only one calendar date of said calendar month;

(D) consecutive integer indicia positioned in proximity to said rupturable zones in a one-to-one relationship thereto so as to be viewable from the rear surface of the backing sheet and so as to visually identify each zone with one and only one calendar date of said calendar month;

whereby the dispenser stores pills in the plurality of pill-containing enclosures in a manner that provides visual identification of each enclosure from both the front and rear of the dispenser, with one and only one calendar date of said calendar month, so that dispensing of the pills on a daily basis is facilitated and whereby monitoring of user compliance with the calendar oriented regimen is facilitated by identification of the pill-containing enclosures which are not dispensed for any given calendar date.

2. A dispenser as defined in claim 1 wherein the domes are formed from a plastic sheet which is fastened to the front surface of the backing sheet.

3. A dispenser as defined in claim 2 wherein the backing sheet is formed from a thin aluminized foil material.

4. A dispenser as defined in claim 1 wherein the backing sheet is formed from a thin aluminized foil material.

5. A dispenser as defined in claim 1 further comprising indicia identifying a particular month of the year for which the dispenser is to be used.

6. A unitary, non-reusable dispenser for the storage, dispensing, and patient compliance indication of calendar oriented pills comprising:

(A) a backing sheet formed from a thin aluminized material having a front and rear surface containing a plurality of rupturable zones, the zones arranged in a plurality of rows, with the total number of zones corresponding to the maximum number of days in a calendar month for which the dispenser is to be used;

(B) a plastic sheet attached to the backing sheet and having a plurality of domes formed therein, each dome dimensioned for overlying one of the zones so as to form a pill-containing enclosure for at least one pill of the calendar oriented drug regimen to be stored and dispensed by the dispenser;

(C) consecutive integer indicia positioned on the front surface of the backing sheet, the integer indicia representing integers from the numeral one to the maximum number of days for which the dispenser is to be used for any given calendar month, each interger indicia positioned in proximity to one of the domes so as to identify that particular dome with one calendar date;

(D) consecutive integer indicia positioned on the rear surface of the backing sheet, the integer indicia representing integers from the numeral one to the maximum number of days for which the dispenser is to be used for any given calendar month, each integer indicia positioned on the backing sheet with respect to one of the zones overlaid by one of the domes;

whereby the user of the calendar oriented prescriptive dispenser can easily identify on both the front and rear surface of the backing sheet a dome and the corresponding pill or pills contained within the dome which are to be taken for any given calendar date, thereby facilitating compliance with a calendar oriented regimen; and whereby compliance with the regimen can be ascertained by determining which domes contain pills after completion of the calendar oriented regimen for a given calendar month.

7. A dispenser as defined in claim 6 for the dispensing of post-menopausal estrogen therapy calendar oriented drugs wherein the pill containing enclosures are arranged in four rows, the first two rows each comprising nine enclosures, each enclosure dimensioned for containing one pill of replacement estrogen, wherein the third row of pill-containing enclosures comprises seven enclosures dimensioned for containing estrogen and progesterone pills, and wherein the fourth row of enclosures comprises up to six enclosures dimensioned for containing a calcium replacement pill for those periods of time when estrogen and/or progesterone/estrogen combination pills are not administered to the user of the dispenser.

8. A dispenser as defined in claim 7 further comprising indicia identifying a particular month of the year for which the dispenser is to be used.

9. A dispenser as defined in claim 7 wherein the integer indicia on the rear surface of the backing sheet are placed within the zone forming part of the pill-containing enclosure so as to facilitate proper dispensing of the pills by the user.

10. A method of dispensing medication which is intended to be taken on a calendar oriented basis comprising the steps of:

(1) storing the medication to be dispensed for each calendar data in a separate enclosure formed on a backing sheet with a front and rear surface, where each enclosure is identified on both the front and rear surfaces with integer indicia corresponding to that calendar date;

(2) arranging the dispensing enclosures in rows; and (3) rupturing the rear surface of the backing sheet of the enclosure corresponding to the calendar date for which the medication is to be dispensed.

11. A method of dispensing medication as defined in claim 10 wherein the medication to be dispensed is in the form of pills.

12. A method of dispensing medication as defined in claim 11, wherein the step of arranging the dispensing enclosures in rows comprises the use of four rows, wherein each of the first two rows comprises nine enclosures, each of these enclosures dimensioned for containing one pill of replacement estrogen, wherein the third row comprises seven enclosures, each of these enclosures dimensioned for containing estrogen and progesterone pills, and wherein the fourth row comprises up to six enclosures, each of these enclosures dimensioned for containing a calcium replacement pill for those periods of time when estrogen and/or progesterone/estrogen pills are not administered to the user of the dispenser.

13. A dispenser as defined in claim 1 wherein the plurality of domes are arranged in four rows, the first two rows each comprising nine enclosures, the third row comprising seven enclosures and the fourth row comprising up to six enclosures.

14. A dispenser as defined in claim 13 for the dispensing of post-menopausal estrogen therapy calendar oriented drugs wherein the first two rows of nine enclosures are each dimensioned for containing one pill of replacement estrogen, wherein the third row of pill-containing enclosures are each dimensioned for containing estrogen and progesterone pills and wherein the fourth row of enclosures are each dimensioned for containing a calcium replacement pill.

15. A unitary, non-reusable dispenser as defined in claim 1 wherein the consecutive indicia positioned in proximity to the domes in a one-to-one relationship are positioned on the front surface of the backing sheet and wherein the consecutive integer indicia positioned in proximity to the rupturable zones in a one-to-one relationship are placed upon the rear surface of the backing sheet.

16. A unitary, non-reusable dispenser as defined in claim 15 wherein the consecutive integer indicia positioned on the rear surface of the backing sheet are placed within the area defined by the rupturable zones for each rupturable zone.

17. A unitary, non-reusable dispenser as defined in claim 16 wherein 31 domes and rupturable zones define 31 pill-containing enclosures.

18. A unitary, non-reusable dispenser as defined in claim 17 wherein the pill-containing enclosures are arranged in four rows, the first two rows comprising nine enclosures, the third row comprising seven enclosures, and the fourth row comprising six enclosures.

19. A unitary, non-reusable dispenser as defined in claim 18 wherein the first two rows of pill-containing enclosures are each dimensioned for containing one pill of replacement estrogen, wherein the third row of pill-containing enclosures are each dimensioned for containing two pills each, one of estrogen and one of progesterone, and wherein the fourth row of pill-containing enclosures are each dimensioned for containing a calcium replacement pill.

20. A unitary, non-reusable dispenser for the storage, dispensing, and patient compliance indication of post-menopausal calendar oriented estrogen therapy pills comprising:

(A) a backing sheet formed from a thin aluminized material having a front and rear surface containing a plurality of rupturable zones, the zones arranged in four rows, the first two rows each comprising nine enclosures, each enclosure dimensioned for containing one pill of replacement estrogen, wherein the third row of pill-containing enclosures comprises seven enclosures dimensioned for containing estrogen and progesterone pills, and wherein the fourth row of enclosures comprises up to six enclosures dimensioned for containing a calcium replacement pill for those periods of time when estrogen and/or progesterone/estrogen combination pills are not administered to the user of the dispenser, with the total number of zones corresponding to the maximum number of days in a calendar month for which the dispenser is to be used;

(B) a plastic sheet attached to the backing sheet and having a plurality of domes formed therein, each dome dimensioned for overlying one of the zones so as to form a pill-containing enclosure for at least one pill of the calendar oriented estrogen therapy regimen to be stored and dispensed by the dispenser; and (C) consecutive integer indicia positioned on the front surface of the backing sheet, the integer indicia representing integers from the numeral one to the maximum number of days for which the dispenser is to be used for any given calendar month, each integer indicia positioned in proximity to one of the domes so as to identify that particular dome with one calendar date;

whereby the user of the calendar oriented prescriptive dispenser can easily identify on the front surface of the backing sheet a dome and the corresponding pill or pills contained within the dome which are to be taken for any given calendar date, thereby facilitating compliance with the post-menopausal estrogen therapy calendar oriented regimen; and whereby compliance with the regimen can be ascertained by determining which domes contain pills after completion of the calendar oriented regimen for a given calendar month.

* * * * *